United States Patent [19]

Haftmann

[11] Patent Number: 5,056,943

[45] Date of Patent: Oct. 15, 1991

[54] LINE-SPACING DEVICE FOR A TYPEWRITER OR THE LIKE

[75] Inventor: Johannes Haftmann, Schwabach, Fed. Rep. of Germany

[73] Assignee: Ta Triumph-Adler Aktiengesellschaft, Nurnberg, Fed. Rep. of Germany

[21] Appl. No.: 559,933

[22] Filed: Jul. 3, 1990

[30] Foreign Application Priority Data

Aug. 3, 1989 [DE] Fed. Rep. of Germany ..... 3925713

[51] Int. Cl.[5] ..... B41J 11/51

[52] U.S. Cl. ..... 400/547.7; 400/551; 400/904

[58] Field of Search ..... 400/547.7, 551, 568, 400/569, 570, 572, 573, 573.1, 575, 555, 556.1, 564, 575.2, 904

[56] References Cited

U.S. PATENT DOCUMENTS 4,531,850 7/1985 Valle et al. ..... 400/551

FOREIGN PATENT DOCUMENTS 89982 6/1982 Japan ..... 400/569
108178 6/1983 Japan ..... 400/575.2
12379 1/1986 Japan ..... 400/904
2202491 9/1988 United Kingdom ..... 400/568

OTHER PUBLICATIONS

IBM Technical Disc. Bulletin, vol. 9 No. 11 4/67 "Line Feed Mechanism".

*Primary Examiner*—Edgar S. Burr
*Assistant Examiner*—Ren Yan
*Attorney, Agent, or Firm*—Browdy and Neimark

[57] ABSTRACT

In a line-spacing device for a typewriter or the like, where a platen, used as a support for the paper, is moved forward in steps by means of a ratchet it is provided for attaining a half-step transport that the gripper point (20) is seated longitudinally displaceable on the ratchet (11) in a direction approximately tangential to the toothed wheel (4) between two end positions determined by detent forces, where the detent force of the gripper point (20) is less than the force of resistance opposed by the toothed wheel (4) with the platen (1) to the drive by means of the gripper point (20) in the course of the tangential transport phase, and where the distance between the two detent end positions in the longitudinal direction corresponds to the tangential transport distance of a half transport step (t).

6 Claims, 2 Drawing Sheets

LINE-SPACING DEVICE FOR A TYPEWRITER OR THE LIKE

FIELD OF THE INVENTION

The invention relates to typewriters and more particularly to a line-spacing device capable of half step movements for a typewriter or the like.

BACKGROUND OF THE INVENTION

In line-spacing devices, a platen, used as a support for the paper, is moved forward in steps by means of a ratchet which is in engagement with a toothed wheel connected on the platen and fixed against relative rotation and forms a gripper switch gear together with it, where the ratchet is driven via an eccentric and a line-spacing motor, and with at least one spring-loaded ratchet engaging the toothed wheel for fixing a defined typing position, as well as with a device for attaining a half-step transport movement reduced in respect to the normal step length. The gripper point of the ratchet describes a closed, elongated movement path, where the longitudinal direction of the movement path is located approximately tangentially to the toothed wheel and where, in a first movement phase of a generally radial path section the gripper point enters a tooth gap, while in a second movement phase an approximately tangential transport, in a third movement phase an approximately radial backward movement and in a fourth phase an approximately tangential return movement takes place.

Such line-spacing devices with a provision for performing a half-step transport movement for making possible, for example, the typing of superscripts or subscripts, are known in various embodiments. However, the known devices in general operate with an electronic control of the line-spacing motor and are, accordingly, relatively expensive in their construction and manufacture.

SUMMARY OF THE INVENTION

It is an object of the invention to provide a line-spacing device with a provision for a half-step transport movement which can be simply and inexpensively produced.

This object is attained in accordance with the invention in that the gripper point is seated on the ratchet between two end positions, defined by detent forces, longitudinally displaceable in a direction approximately tangential to the toothed wheel, where the detent force of the gripper point is less than the force of resistance with which the drive by means of the gripper point is opposed by the toothed wheel with the platen in the course of the tangential transport phase, and where the distance between the two detent end positions corresponds in the longitudinal direction to the tangential transport distance of one-half of a transport step.

Thus, the essence of the object of the invention resides in that at each reversal of the direction of the transport rotation, i.e. during a change of the engagement movement of the gripper point from a pulling to a pushing movement or vice versa, first a longitudinal displacement of the gripper point takes place with engagement, because the resistance to displacement is less than the force of inertia of the platen in the position it has taken up. This force of inertia is essentially determined by the holding force or spring force of the detents. By means of a displacement of the gripper point during engagement in the course of such a reversal of the transport movement, the effective tangential transport distance, which is translated into a rotational and thus an advancing movement of the platen, is reduced by the displacement distance of the gripper point. If, accordingly, the displacement distance of the gripper point possible between two end positions exactly corresponds to the transport movement of a half step, it is possible in this manner to trigger a half-step transport movement by means of a reversal of the direction of rotation. During every subsequent transport movement in the same direction the gripper point takes up an end position and is forced away from the direction of the other end position, i.e. it can no longer be deflected, in spite of the transport resistance of the platen, and takes the latter along over the entire engagement distance, so that the platen performs a whole transport step. The platen and the gripper point again attain the normal full-step transport phase by means of two subsequent changes in the direction of transport.

This means that for typing, for example a superscript, it is only necessary to switch from the previous forward transport to reverse transport, where a half-step is automatically performed. Vice versa, when typing a subscript, first a full transport step in the original direction must be performed where, by performing a further transport step in the form of a half step in the opposite direction of transport, a position is reached which is offset by a half step in respect to the previous line of typing.

Forward transport of course, occurs while the platen is driven counterclockwise. Accordingly, the one-half step to achieve the above described superscript or subscript occurs in the first increment of driving the platen in a clockwise direction.

In a further embodiment of the invention it is provided that the gripper point is longitudinally displaceable via a groove or longitudinal recess and a guidance device. The groove may be formed, for example extending longitudinally, in the gripper point and the guidance device can be in the form of a slotted retaining head, so that the gripper point can be locked in the groove and the retaining head overlaps the groove in the locked state.

In principle it is conceivable to define the end positions exclusively by the ends of the guide slit and to generate the locking or detent power in the end positions by means of defined, selected friction. This might be achieved, for example, with the aid of the spring legs of the retaining head. In a preferred embodiment of the invention it is provided for attaining end positions with distinct, defined detent forces that the gripper point has a spring tongue with a detent projection extending beyond it, which comes to rest in one of two detent recesses on the ratchet, which define the end positions. This detent projection may have, for example, a hemispherical configuration, where the recesses can be in the form of two grooves which are parallel to each other and extend vertically to the displacement path of the gripper point.

To attain a defined detent moment for the platen in the normal, full-step positions as well as in the interspersed half-step positions, preferably at least two detents are provided, which are offset by one-half of a tooth width of the toothed wheel in such a way that in the stable end position one detent always engages a tooth interval with its point and one detent lies with its point on the tip of a tooth.

The two detents can be advantageously produced in such a way that they are disposed on a common support element and each is formed by leaf spring elements, which engage the toothed wheel from sides which are approximately opposite.

BRIEF DESCRIPTION OF THE DRAWINGS

The invention will be described in detail below by means of a preferred embodiment in connection with the drawings, in which.

DETAILED DESCRIPTION OF THE PREFERRED EMBODIMENTS

Figure 1:
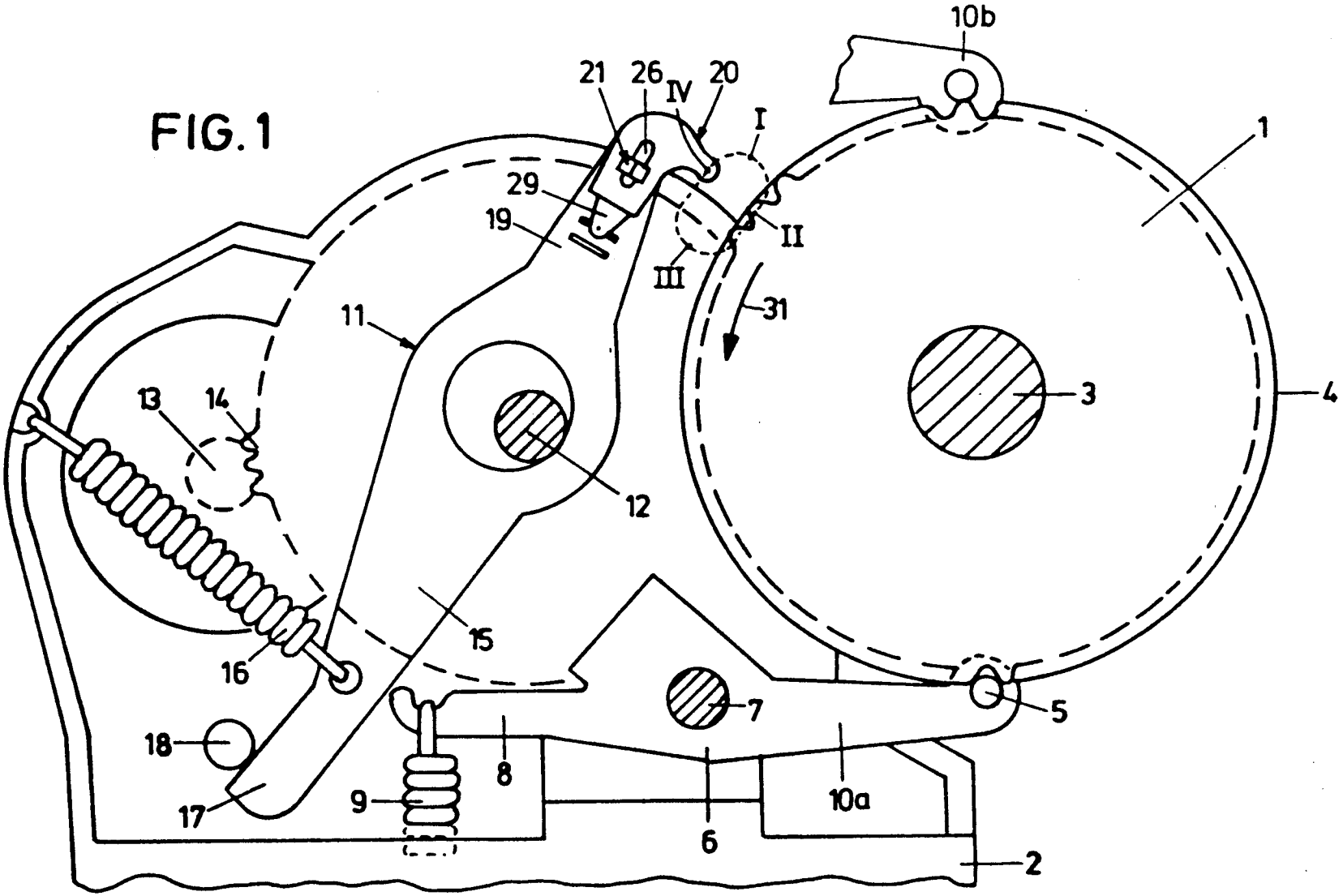
FIG. 1 is a schematic section of a line-spacing device in accordance with the invention to illustrate the essential components.

A platen 1, rotatably seated on a shaft 3 disposed in a machine frame 2, is shown in FIG. 1. A toothed wheel 4 is also seated on the shaft and adjoins the platen on its outside. The point 5 of a lever or detent 6 engages the toothed wheel 4 and is pivotably seated on shaft 7 fixed on the side of the housing. The lever 6 has a rear lever arm section 8 which is under the influence of a helical spring 9 fastened on the machine frame side, so that the front arm section 10*a* or 10*b* of the lever 6 is pressed with its point 5 against the toothed wheel 4. Only one such detent or lever 6 is fully drawn in FIG. 1 for the purpose of a schematic description and the other detent having front arm section 10*b* is only sketched. Within the framework of the embodiment according to the invention, this second detent having arm 10*b* is provided such that it has a point which is offset by a half tooth pitch t of the toothed wheel 4, i.e. it rests against a tooth tip as shown when the point 5 of the arm 10*a* of detent 6 engages a tooth space.

Furthermore a ratchet 11, seated pivotably driven on an eccentric shaft 12, is provided for driving the toothed wheel 4 and thus the platen 1. Drive is performed by means of a line-spacing motor 13 and a toothed wheel 14 seated on the shaft 12.

A helical tension spring 16 fastened on the machine frame 2 acts on the rear lever section 15 of the ratchet 11 and presses the end 17 of the lever arm section 15 against a stop 18 fixed on the machine frame 2.

Figure 2A:
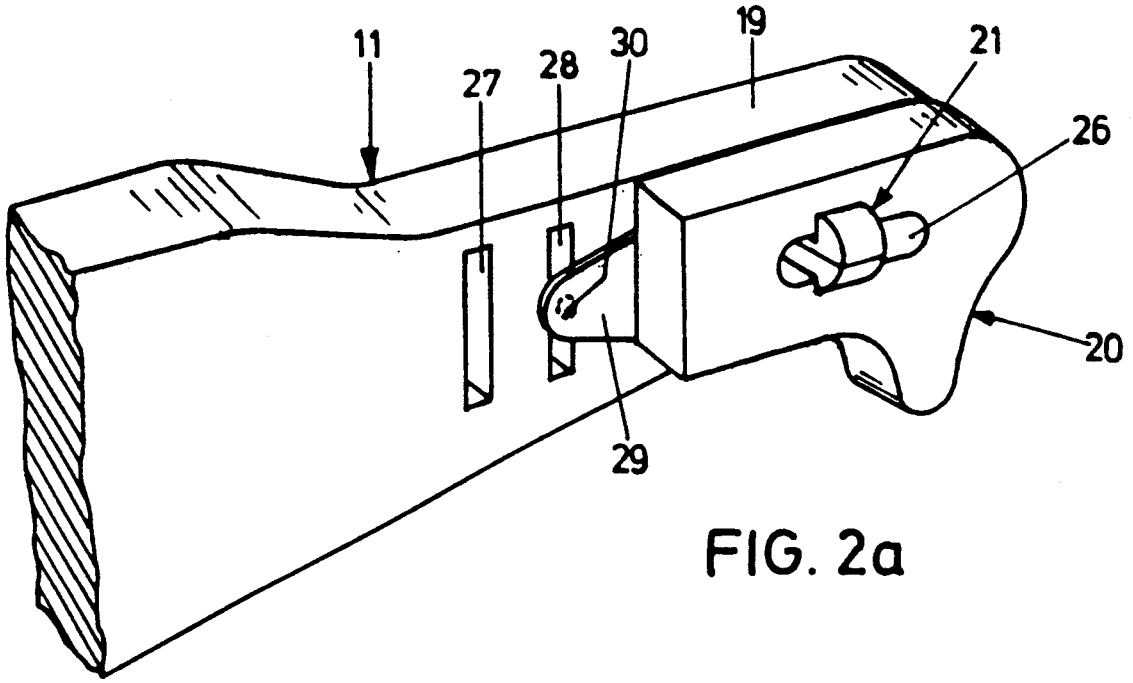
FIGS. 2*a* and 2*b* show the front end of the ratchet with the longitudinally displaceable gripper point in each one of the end positions.
Figure 2B:
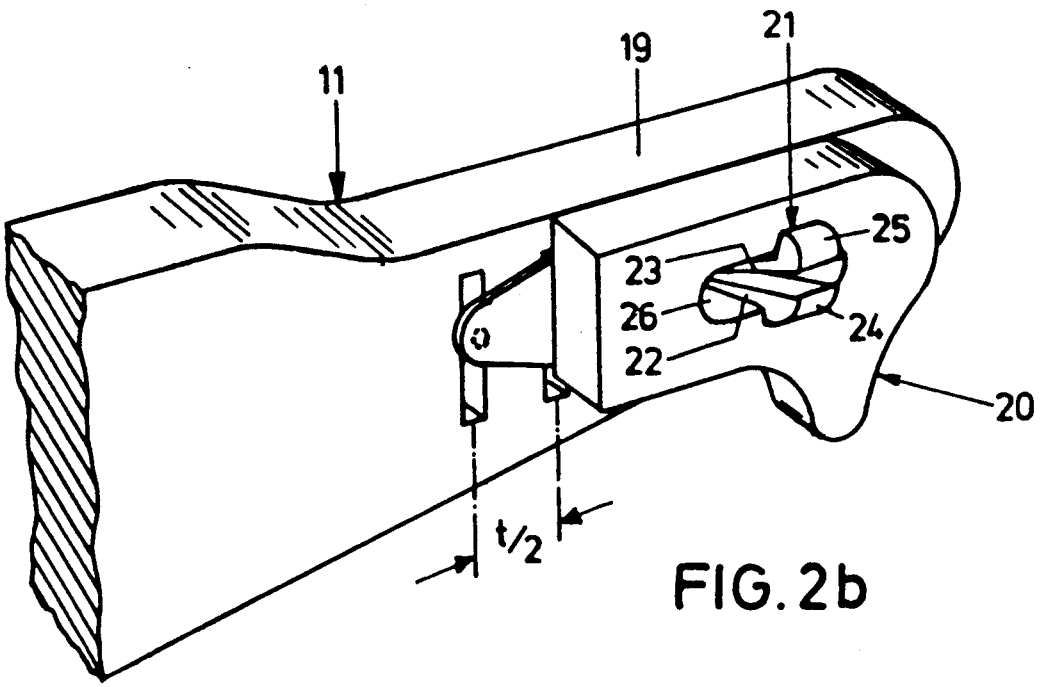

A gripper point 20, shown in detail in FIG. 2, is disposed on the front lever arm section 19 of the ratchet 11. The gripper point 20 is lockingly disposed on the ratchet 11. The ratchet 11 has a guide projection 21 with two arms 22, 23, which have thickened detent sections 24, 25 at their respective ends. The two arms 22, 23 can be flexibly pressed together, so that the gripper point 20 can be lockingly disposed by means of its longitudinal slot 26, and the sections 24, 25 expand after passing through the slot 26 and fix the gripper point 20 in a manner where it can be displaced in the longitudinal direction along the slot 26. Two grooves 27, 28 are formed parallel to each other on the ratchet. A projection 29 is provided on the rear part of the gripper point 20, on the inside of which, not visible in FIG. 2, a hemispheric detent projection 30, only shown in dashed lines, can be locked into the grooves 27, 28. The projection 29 may be made of plastic extruded in one piece, for example. Because of the dimensions of the slot 26, the gripper point 20 can be longitudinally displaced, overcoming the detent force defined by the spring force of the projection 29, so that the gripper point reaches the one end position shown in FIG. 2*b* from the other end position shown in FIG. 2*a*, and vice versa.

As shown by dashed lines in FIG. 1, the gripper point 20 describes a closed, somewhat elliptical path of movement. During a first movement phase approximately radially to the platen 1 or the toothed wheel 4, the gripper point 20 enters a tooth gap. In a subsequent second transport phase approximately tangentially to the toothed wheel 4, the toothed wheel is being taken along. In a third movement phase in an approximately radial direction the gripper point 20 is brought into a position where it is out of engagement. And in a fourth, approximately tangential movement phase, it is brought back again. During the reverse drive direction the present path of movement is traversed in the opposite direction, where the transfer of force to the toothed wheel 4 takes place by means of a pushing movement, instead of a pulling movement.

When half steps are performed, operation is as follows: Starting from an end position of the gripper point 20 as shown in FIG. 2*a*, i.e. the gripper point is in its forward, extended end position and engages the toothed wheel 4 in such a way that a pulling movement, i.e. a transport movement in the direction of the arrow 31, is performed, the force of resistance of the toothed wheel 4 opposes a movement in a direction toward the outside in the course of this pulling movement. This force is fully absorbed and, with this direction of rotation of the line-spacing motor 13 being maintained, a line spacing with full steps takes place in the conventional manner.

If a reversal of the direction of rotation now takes place, the gripper point 20 engages the toothed wheel 4 in accordance with the movement phase III and exerts a pushing effect opposite the direction of the arrow 31. If again the resistance to movement of the toothed wheel 4 acts on the gripper point 20, the gripper point is brought from the position drawn in FIG. 2*a* into the position drawn in FIG. 2*b* because of the reduced detent force, i.e. the hemispherical detent projection 30 is moved out of the groove 28 and comes to rest in the groove 27. The two grooves have a distance from each other which corresponds to one-half of the pitch t of the toothed wheel 4.

The result of this is that in the movement phase II, where the gripper point 20 is in a push connection with the toothed wheel 4, first an idle stroke of t/2 takes place, which is caught by the displacement of the gripper point 20, and only when the end position has been attained, i.e. when the detent projection 30 is lockingly engaged in the groove 27, the resistance to rotation of the platen 1 is overcome and a pushing transport movement by a half step occurs.

If now the drive of the ratchet 11 continues to be in the same direction, the next pushing movement starts from a stable end position, i.e. the gripper point 20 can no longer be deflected towards the inside and, accordingly, a full transport step again takes place.

Only when a change of direction again occurs and the gripper point 20 now acts according to the movement phase I and, in accordance with movement phase II, tries to perform a tangential transport movement in the direction of the arrow 31, the gripper point 20 is first brought from the position shown in FIG. 2*b* into the position shown in FIG. 2*a* on account of the lesser detent force of the gripper point 20 in comparison to the resistance to rotation of the platen 1, until again a stable end position has been achieved. This means that again the effective transport movement is reduced by a distance corresponding to one-half pitch, so that in this case again first only a half step is performed. All further drive movements in the same direction of rotation are again fully performed.

The two detents or their lever arms 10*a* and 10*b* are offset from each other by one-half pitch in the direction of rotation, so that one of the detents engages a tooth gap, while the other detent comes to rest on the tip of a tooth. The two detents may be in the form of leaf springs and may be disposed with an appropriate offset on a common holder.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A superscript or subscript line spacing device for use with a typewriter or the like, said typewriter or the like having, a rotatable paper support platen (1), a toothed wheel (4) mounted on said platen (4), at least one-spring loaded detent means releaseably engaging said toothed wheel (4) for maintaining said platen (1) in a defined typing position to which said platen (1) has been moved, an eccentric shaft (12) arranged to rotate selectively and cyclically in a clockwise direction and in a counterclockwise direction, a ratchet (11) slideably rotating on said eccentric shaft around a circular mid-section opening and substantially fixed at a first end against relative rotation, said ratchet (11) having a gripper point (20) at a second end for intermittently engaging and rotating said toothed wheel (4), a line spacing-motor driving said eccentric shaft with said ratchet (11) and said gripper point (20) to normally rotate said toothed wheel (4) and said platen (1) counterclockwise and clockwise from typing line to typing line in full steps, said superscript or subscript line spacing device comprising, means moveably connecting said gripper point (20) to said ratchet (11) for adding superscript or subscript between normal typing lines by selectively rotating said platen (1) one-half step.

2. The line spacing device for claim 1, wherein said means for adding superscript or subscript between normal lines is activated at the point of rotating said platen in a clockwise direction.

3. The line spacing device of claim 2, wherein said means for adding superscript or subscript comprises, two gripper point end positions on said ratchet, the space between said two gripper point end positions in a direction approximately tangential to said platen (1) equal to one-half a full step of said platen (1), said gripper point (20) selectively moveable in said space upon reversal of rotation of said ratchet (11), said gripper point having a detent for retaining said gripper point in a selected one of either of said two gripper point end positions until reversal of rotation of said ratchet (11).

4. A line spacing device in accordance with claim 3, wherein the gripper point (20) is moveable in said space by means of a longitudinal slot (26) and a guide element (21).

5. A line spacing device in accordance with claim 4, wherein the gripper point (20) has a resilient tongue (29) with a detent projection (30) extending beyond it, which comes to rest in one of two detent recesses (27, 28) on the ratchet (11) which define the end positions.

6. A line spacing device in accordance with claim 5, wherein at least two detents (10*a*, 10*b*) are provided, which are offset by one-half of a tooth width t/2) of the toothed wheel (4) in such a way that in the end position one of either of said detents (10*a*, 10*b*) always engages a tooth interval with its point and the other of either of said detents (10*b*, 10*a*) lies with its point on the tip of a tooth.

* * * * *